US008111861B2

(12) United States Patent
Lowry

(10) Patent No.: US 8,111,861 B2
(45) Date of Patent: Feb. 7, 2012

(54) EARBUD THAT SECURES TO THE TRAGUS AND ANTI-TRAGUS OF THE EAR

(75) Inventor: David Lowry, Wayne, PA (US)

(73) Assignee: Auria LLC, Malvern, PA (US)

( * ) Notice: Subject to any disclaimer, the term of this patent is extended or adjusted under 35 U.S.C. 154(b) by 933 days.

(21) Appl. No.: 12/122,812

(22) Filed: May 19, 2008

(65) Prior Publication Data

US 2009/0285436 A1 Nov. 19, 2009

(51) Int. Cl.
*H04R 25/00* (2006.01)

(52) U.S. Cl. ..... 381/380; 381/328; 181/135

(58) Field of Classification Search ..... 381/380, 381/328–329, 309, 371, 374, 71.6; 181/129–130, 181/125; D14/205, 233
See application file for complete search history.

(56) References Cited

U.S. PATENT DOCUMENTS

| | | | | |
|---|---|---|---|---|
| 4,972,492 | A | 11/1990 | Tanaka et al. | |
| 6,047,076 | A | 4/2000 | Yang | |
| 6,412,593 | B1 | 7/2002 | Jones | |
| 6,772,853 | B2 | 8/2004 | Yang | |
| 6,819,762 | B2 | 11/2004 | Jones et al. | |
| 2002/0131585 | A1* | 9/2002 | Jones et al. | 379/431 |
| 2007/0253587 | A1 | 11/2007 | Ostrowski | |
| 2008/0013774 | A1* | 1/2008 | Hosaka et al. | 381/380 |
| 2008/0019554 | A1 | 1/2008 | Krywko | |
| 2008/0025539 | A1* | 1/2008 | Bailey et al. | 381/322 |
| 2008/0264715 | A1* | 10/2008 | Leong et al. | 181/135 |

FOREIGN PATENT DOCUMENTS

WO WO 2004100508 A1 * 11/2004

OTHER PUBLICATIONS

International Search Report and Written Opinion of the International Searching Authority from corresponding Application No. PCT/US09/44508, dated Jul. 13, 2009, 10 pages.
Notification of Transmittal of the International Search Report and the Written Opinion of the International Searching Authority dated Jul. 13, 2009, from related PCT Application No. PCT/US/09/44508.

* cited by examiner

*Primary Examiner* — Thao Le
*Assistant Examiner* — Allen Parker
(74) *Attorney, Agent, or Firm* — Panitch Schwarze Belisario & Nadel LLP

(57) ABSTRACT

An earphone projects sound into an ear having an acoustic meatus, a tragus, an intertragic notch, an anti-tragus and a canal. The earphone includes a base that is positioned proximate an outer surface of the tragus and anti-tragus when the earphone is mounted to the ear. A speaker housing at least partially contacts the acoustic meatus of the ear and includes a speaker cover positioned proximate the canal when the earphone is mounted to the ear. First and second tragus lobes extend from the base generally toward the speaker housing. The first and second tragus lobes are spaced from and positioned on generally opposite lateral sides of the speaker housing. The anti-tragus being held between the first tragus lobe and the base when the earphone is mounted to the ear and the tragus being held between the second tragus lobe and the base when the earphone is mounted to the ear.

16 Claims, 11 Drawing Sheets

EARBUD THAT SECURES TO THE TRAGUS AND ANTI-TRAGUS OF THE EAR

BACKGROUND OF THE INVENTION

The present invention relates to an earphone, specifically an earphone that secures to the tragus and anti-tragus of the ear and has a removable decorative outer cap.

Referring to FIG. 1, compact, low profile, light-weight conventional earphones 5 are known that hold speakers (not shown) to a user's outer ears 2 and are connected by a wire 3 or wirelessly to a stereophonic, monophonic or binaural audio-frequency signal source such as an audio amplifier, radio, computer, compact disc player, MP3 player 4 or other media player. There are many different types of earphones 5, with the listening situation and the needs of the listener determining what type of earphone 5 will be used. Generally, there are four types of headphones: circumaural, supra-aural, earbud or earphone 5, and in-ear or canalphones. Circumaural headphones (not shown) have circular or ellipsoid earpads that fit around and over the ears 2 and block out virtually all outside noise. Circumaural headphones are commonly used in recording studios and among audio enthusiasts. However, circumaural headphones are bulky and are therefore undesirable when the user is actively moving, such as running, and when a certain level of outside noise needs to be heard, such as a car horn, oncoming traffic, alarms or airport announcements. Supra-aural headphones (not shown) have pads that sit on top of the ears 2, rather than around them, such that a certain level of outside noise can be heard. However, supra-aural headphones do no stay attached to the ear 2, unless a clip wraps around the ear 2 or head, and the bulky size also makes them visually unattractive.

Referring to FIGS. 2A, 2B and 2C, earphones 5 fit in a cavity or pocket proximate an acoustic meatus 6 of the external ear 2 such that the earphone 5 remains in the ear 2. The ear 2 includes a downwardly extending lobule 8 and a helix 9 that extends around the outer periphery of the ear 2. A concha 10 extends generally horizontally across the ear 2. An intertragic notch 11 is formed between an outwardly extending tragus 12 and an inwardly extending antitragus 13. The intertragic notch 11, the tragus 12 and the antitragus 13 extend around the periphery of the acoustic meatus 6 forming a pocket that directs sound into an ear canal 7. Earphones 5, such as those that are bundled with Apple's iPod® and other media devices, rest in the pocket formed between the tragus 12, the antitragus 13 and the acoustic meatus 6. Earphones 5 are headphones 1 of a smaller size that are placed directly outside of the ear canal 7, but without fully sealing off the ear canal 7 such that outside noise can enter the ear canal 7 around the earphone 5. Earphones 5 are generally inexpensive and are favored for their compact size, portability and convenience. However, because ears 2 differ greatly in size and shape between different users and the earphones 5 do not attach to the ear 2, earphones 5 may unintentionally detach from a user's ear 2.

Canalphones, also known as in-ear monitors, or IEMs, (not shown) have been developed that extend into and plug or seal the ear canal 7. Canalphones are less likely to detach from a user's ear 2 as compared to earphones 5, but they typically isolate the user from most outside noise which may be undesirable, and potentially dangerous, in certain instances as mentioned above. Also, unless the canalphone has a much more expensive custom fit, a universal canalphone may not comfortably fit within the uniquely shaped canal 7 of a user.

Because earphones 5 rest on the outside of the ear 2, earphones 5 also serve as a fashion accessory. Because earphones 5 generally have the same low profile shape, the color of the earphone 5 is typically the only feature that an image conscious individual can alter to distinguish their earphones 5 from someone else or match their earphone 5 to an outfit, activity or artistic expression.

Further, conventional earphones 5 often have an open grille or vent holes 14 on the back of the earphone 5, allowing sound waves to propagate out of the housing and freely away from the ear 2. Earphones 5 with vent holes 14 or open canalphones usually have less sound distortion due to the lack of earcup resonances. However, some of the sound directed away from the ear is not heard and may result in decreased sound quality.

It would be desirable to provide an earphone that secures to the tragus and anti-tragus of the ear and more specifically has adjustable tragus arms for attaching to differently sized ears or for adjusting the tightness of the fit to an ear and/or has adjustable or replaceable resilient rings proximate the speaker cover. It would also be desirable to provide an earphone that has a removable decorative outer cap for changing the aesthetics of the earphone.

BRIEF SUMMARY OF THE INVENTION

Briefly stated, the present invention is directed to an earphone for projecting sound into an ear that has an acoustic meatus, a tragus, an intertragic notch, an anti-tragus and a canal. The earphone includes a base positioned proximate an outer surface of the tragus and anti-tragus. A speaker housing extends from the base and at least partially contacts the acoustic meatus of the ear and includes a speaker cover positioned proximate the canal. At least one tragus lobe extends from the base and forms a space between the base and the speaker housing. The tragus or the anti-tragus extends into the space and is held between the at least one tragus lobe and the base when the earphone is mounted to the ear.

In another aspect, the invention is directed to an earphone for projecting sound into an ear having an acoustic meatus, a tragus, an intertragic notch, an anti-tragus and a canal. The earphone includes a base that is positioned proximate an outer surface of the tragus and anti-tragus when the earphone is mounted to the ear. A speaker housing at least partially contacts the acoustic meatus of the ear and includes a speaker cover positioned proximate the canal when the earphone is mounted to the ear. First and second tragus lobes extend from the base generally toward the speaker housing. The first and second tragus lobes are spaced from and positioned on generally opposite lateral sides of the speaker housing. The anti-tragus being held between the first tragus lobe and the base when the earphone is mounted to the ear and the tragus being held between the second tragus lobe and the base when the earphone is mounted to the ear.

In another aspect, the invention is directed to an earphone for projecting sound into an ear having an acoustic meatus, a tragus, an intertragic notch, an anti-tragus, a concha and a canal. The earphone includes a base that is positioned proximate an outer surface of the tragus and anti-tragus when the earphone is mounted to the ear. An initial cap is removably secured to a first portion of the base. The initial cap includes an exposed outer surface that has a decorative printed graphic, a decorative protrusion extending outwardly from the cap, a jewel and/or a light. A speaker housing extends from a second portion of the base. The speaker housing includes a speaker cover positioned proximate the canal and at least partially contacts the acoustic meatus of the ear when the earphone is mount to the ear.

In another aspect, the invention is directed to a decorative earphone kit that includes a first package that has a pair of earphones that each have a base positioned proximate an outer surface of a tragus and an anti-tragus when each earphone is mounted to an ear. Each earphone includes an interchangeable first cap that has an outer surface. Each first cap is removably and selectively secured to a first portion of each base. The first caps and the base are configured such that only one first cap can be secured to the base at one time. A speaker housing extends from a second portion of the base and at least partially contacts an acoustic meatus of an ear when the earphone is mounted to the ear. The decorative earphone kit includes a second package that has a pair of second caps that each has an outer surface that is different than the outer surface of the first caps. The second caps are removable from the second package and removably and selectively secured to the first portion of each base of the earphones from the first package. The second caps and the base are configured such that only one second cap can be secured to the base at one time.

In another aspect, the invention is directed to a method of distributing a pair of earphones and a plurality of differently decorated caps for interchangeable use therewith. The method includes the steps of: placing two earphones each having a base and a removable first cap in a first package, each first cap having an exposed outer surface and being removably and selectively secured to a first portion of each base; shipping the first package to a retail establishment for sale; placing at least two second caps each having an exposed outer surface in a second package, the exposed outer surfaces of the second caps each having a different ornamental appearance than each of the exposed outer surfaces of the first caps; shipping the second package to the retail establishment; and displaying the first and second packages at the retail establishment to allow a user to purchase the first and second packages.

BRIEF DESCRIPTION OF THE SEVERAL VIEWS OF THE DRAWINGS

The following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
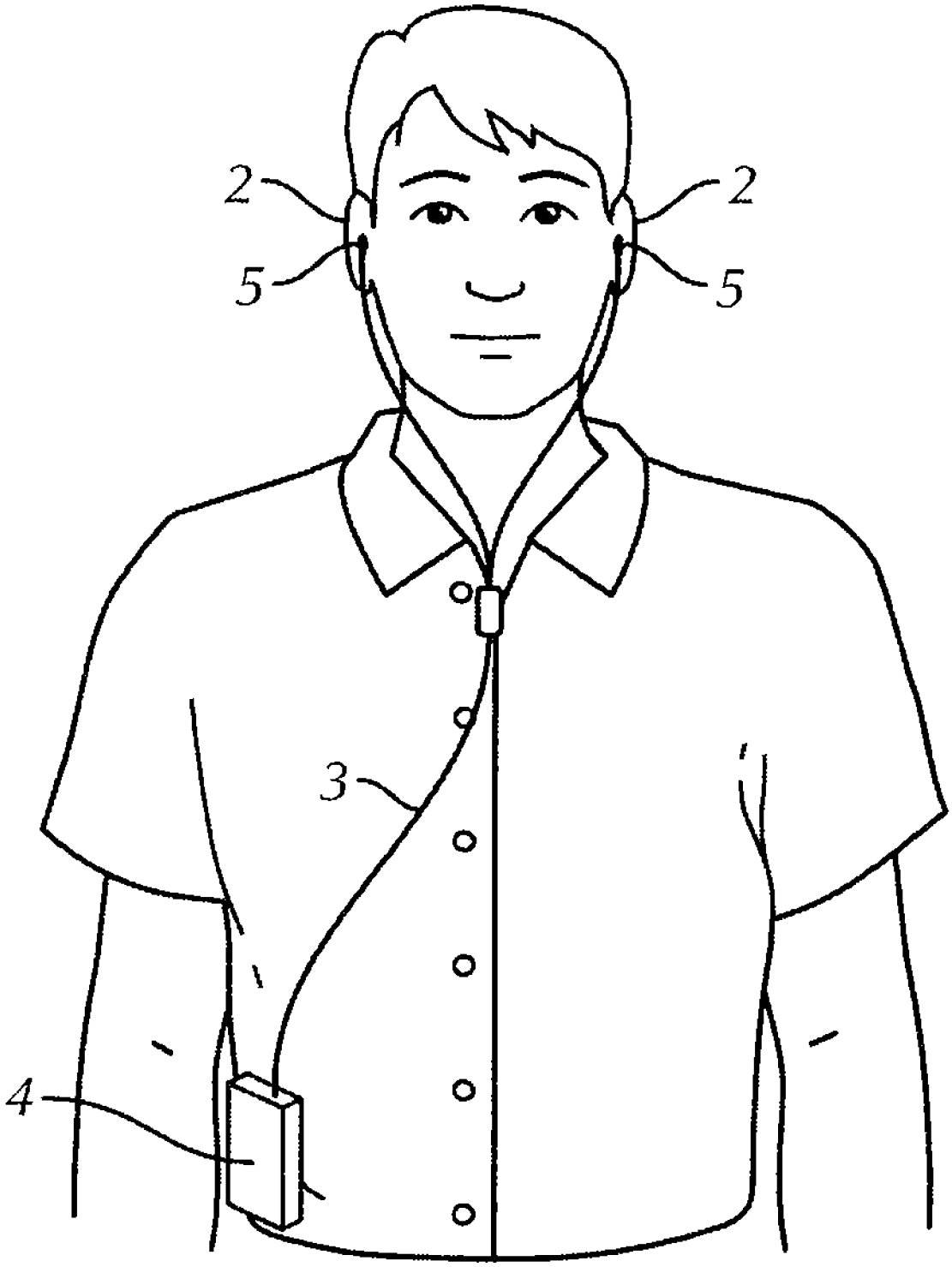
FIG. 1 (Prior Art)
FIG. 1 is a schematic view of a conventional earphone and media player on a user as is known in the art.

Certain terminology is used in the following description for convenience only and is not limiting. The words "right", "left", "lower" and "upper" designate directions in the drawings to which reference is made. The words "inwardly" and "outwardly" refer to directions toward and away from, respectively, the geometric center of the earphone and designated parts thereof. Unless specifically set forth herein, the terms "a", "an" and "the" are not limited to one element but instead should be read as meaning "at least one". The terminology includes the words noted above, derivatives thereof and words of similar import.

Referring to the drawings in detail, wherein like reference numerals indicate like elements throughout for the various embodiments, there is shown in FIGS. 3-6 a first preferred embodiment of an earphone, generally designated 20, in accordance with the present invention. The earphone 20 is used to projected sound into a user's ear canal 7. The earphone 20 shown and described below is for use with a user's left ear 2. An earphone (not shown) for use with the user's right ear 2 is preferably a mirror image of the earphone 20. Two earphones 20 are preferably used together for listening to sound in stereo without disturbing others. However, the earphone 20 may be used as or in conjunction with any listening device such as a headset or a mobile mono-headset for use with a cell phone (not shown) or any other device.

Figure 3:
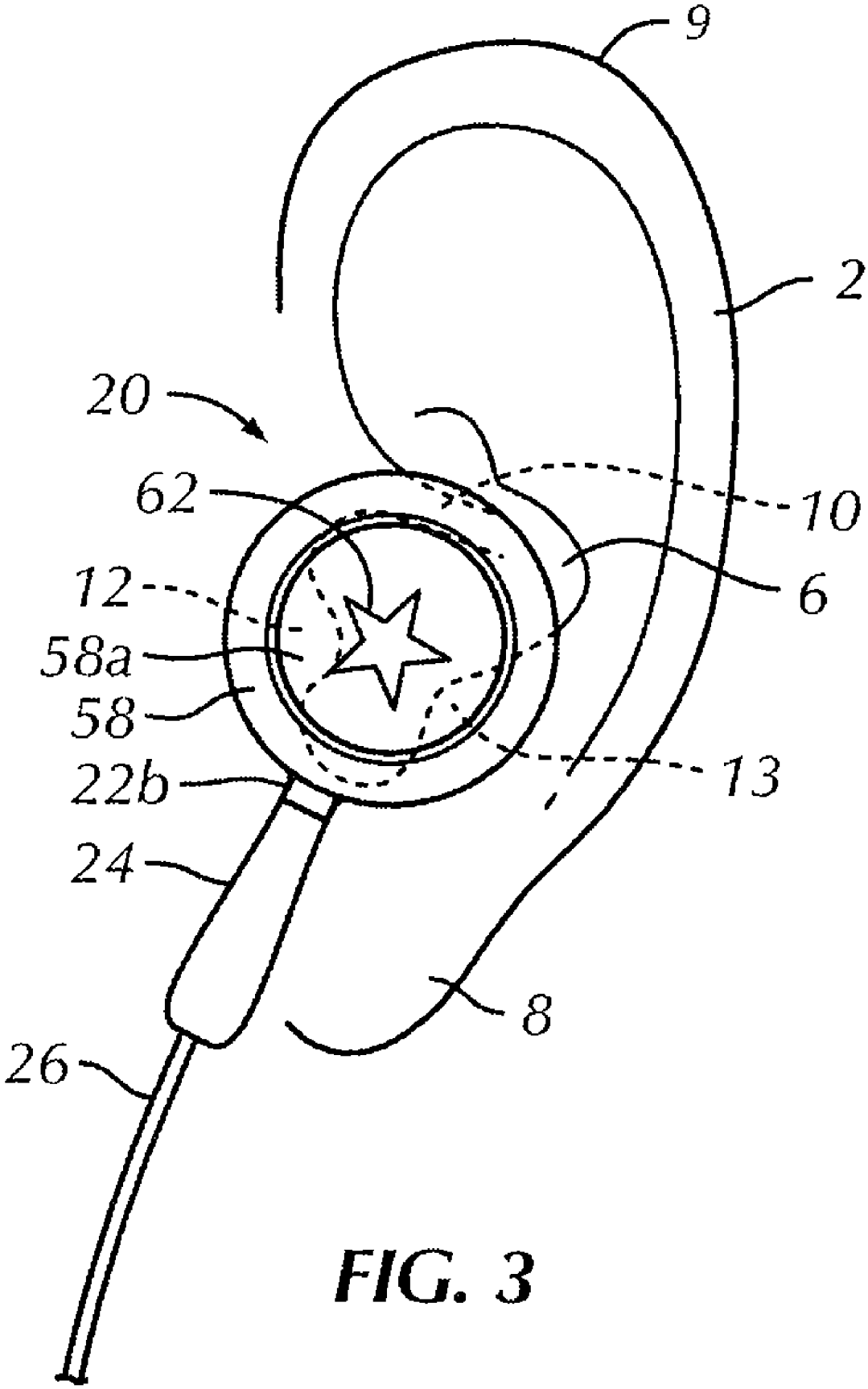
FIG. 3 is a perspective view of an earphone in accordance with a first preferred embodiment of the present invention shown mounted to a user's left ear.
Figure 4:
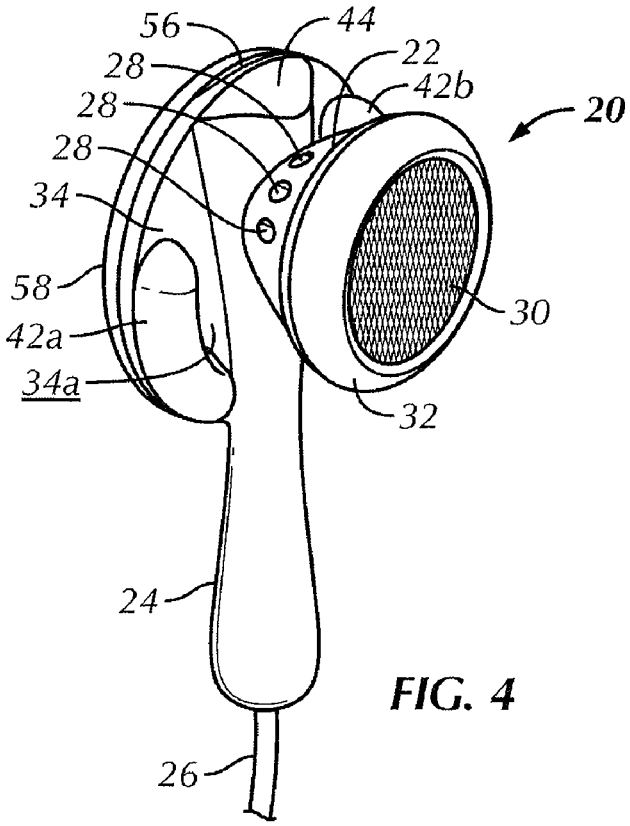
FIG. 4 is a front side perspective view of the earphone shown in FIG. 3.

Referring to FIGS. 3 and 4, the earphone 20 includes a speaker housing 22 for enclosing a speaker and electrical components (not shown) and a wire housing 24 for housing electrical wiring (not shown) extending from the speaker housing 22. The wiring is encased in a protective sheath 26. The speaker housing 22 and the enclosed electronics, the wire housing 24, the sheath 26 and the wiring within the sheath 26 are similar to the respective components of the conventional earphone 5. The speaker housing 22 and the wire housing 24 are preferably constructed of a molded, generally rigid, polymeric material and the sheath 26 is preferably constructed of a flexible polymeric material as is known in the art. The details of the components within the speaker and wire housings 22, 24 are known by one having ordinary skill and the art and further detail of the internal components of the speaker and wire housings 22, 24 is omitted for brevity purposes only and is not limiting.

Figure 2A:
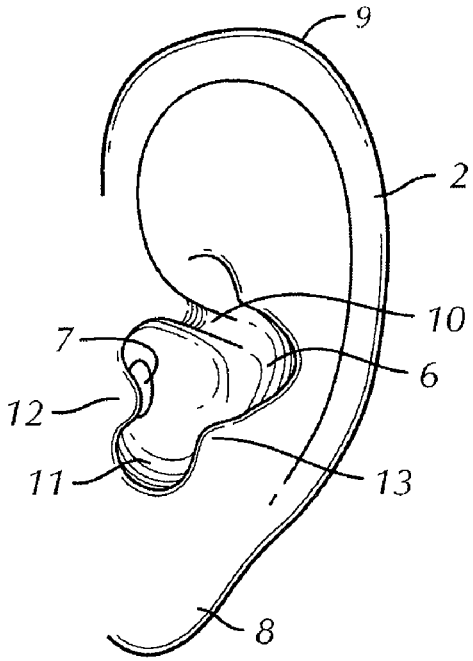
FIG. 2A (Prior Art)
FIG. 2A is a left side elevational view of an ear as known in the art.
Figure 2B:
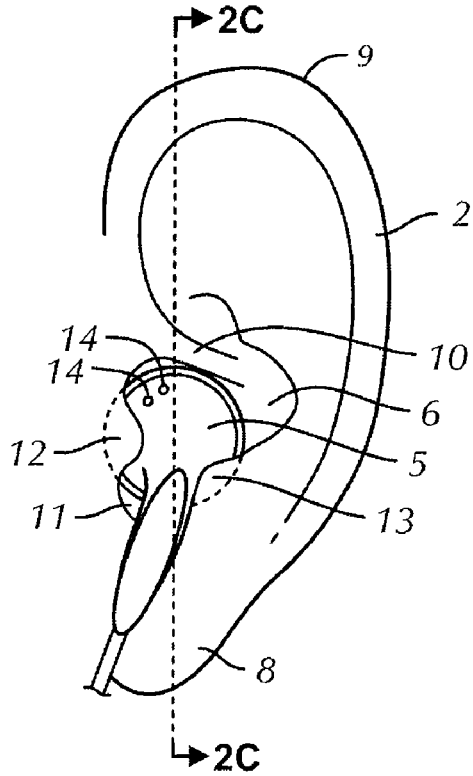
FIG. 2B (Prior Art)
FIG. 2B is left side elevational view of the ear shown in FIG. 2A with a conventional earphone mounted therein as is known in the art.
Figure 2C:
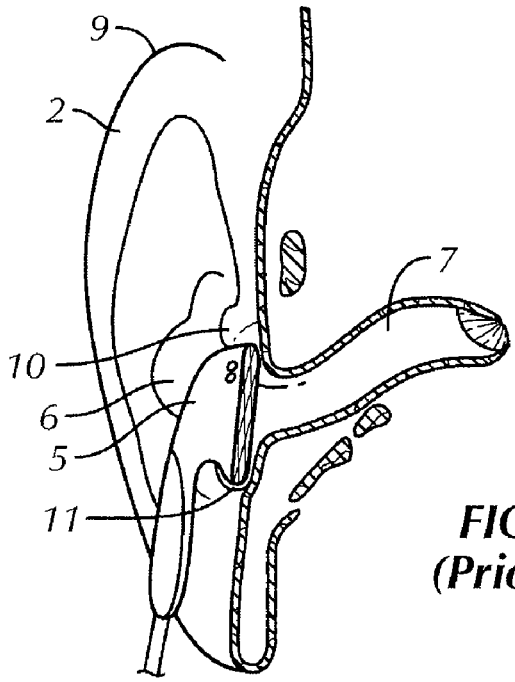
FIG. 2C (Prior Art)
FIG. 2C is a partial cross-section view of the ear and conventional earphone of FIG. 2B taken along line 2C-2C of FIG. 2B.

The speaker housing 22 is preferably frusto-conically-shaped such that when the earphone 20 is mounted to an ear 2 (FIG. 3), the speaker housing 22 at least partially contacts the acoustic meatus 6 between the tragus 12 and anti-tragus 13 of the ear 2 and the wire housing 24 extends through and rests on the intertragic notch 11 similar to the conventional earphone 5 (details of the ear shown in FIGS. 2A and 3). The wire housing 24 preferably extends downwardly from a base 34 and the sheath 26 extends downwardly through the wire housing 24. However, the wire housing 24 may be contained within the base 34 and may extend no further than the outer periphery of the base 24. The wire housing 24 and the base 34 are preferably integrally molded, but the wire housing 24 and the base 34 may be separately formed. The speaker housing 22 may include one or more vent holes 28 to allow sound and air to enter and exit the rear of speaker housing 22 as known by one of ordinary skill in the art.

Referring to FIG. 4, the speaker housing 22 includes a speaker cover 30 for allowing sound to project through the speaker housing 22 and toward and eventually into the ear canal 7. The speaker cover 30 is constructed of a finely grated metallic screen or a porous polymeric screen as is generally known in the art. The speaker housing 22 also preferably includes a resilient ring 32 extending around the outer periphery of the speaker housing 22 at the largest diameter such that the resilient ring 32 at least partially contacts the ear 2. The resilient ring 32 preferably reduces the pressure on the ear 2 as compared to the rigid polymeric material of the speaker housing 22. The resilient ring 32 is preferably removably mounted to the speaker housing 22 such that the resilient ring 32 may be replaced by a new or differently sized resilient ring 32 and is held in place by a compress and grooved fit (not visible). The resilient ring 32 is preferably constructed of a rubber material but may be constructed of any elastomeric, resilient or pliant material, such as silicon or foam. Though it is preferred that the resilient ring 32 be ring-shaped, the resilient ring 32 may have any shape and may cover a larger portion of the speaker housing 22 with the exception of covering the speaker cover 30. Similarly, the wire housing 24 may have a resilient component (not shown) or covering such that the intertragic notch 11 is in contact with the resilient component.

Figure 5:
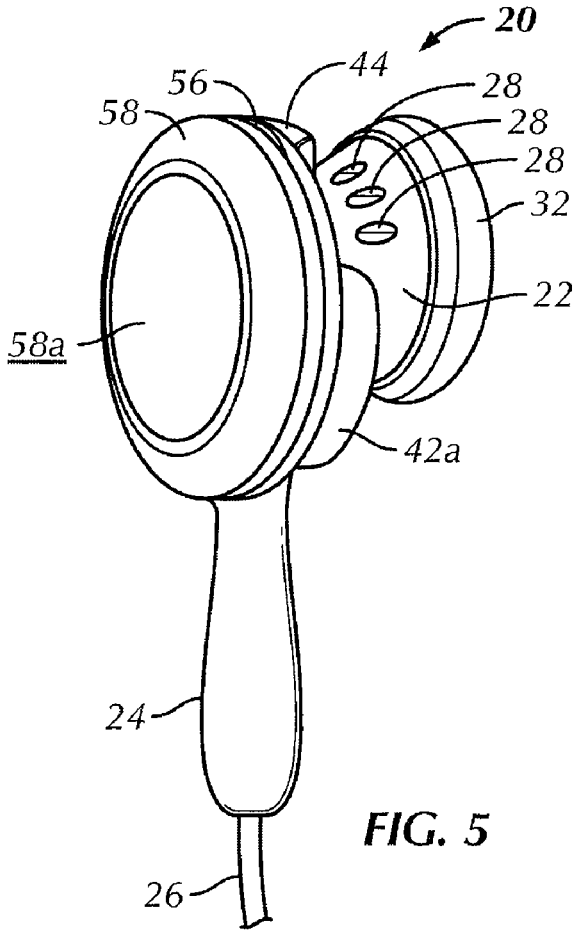
FIG. 5 is a rear side perspective view of the earphone shown in FIG. 3 having a first cap.
Figure 6:
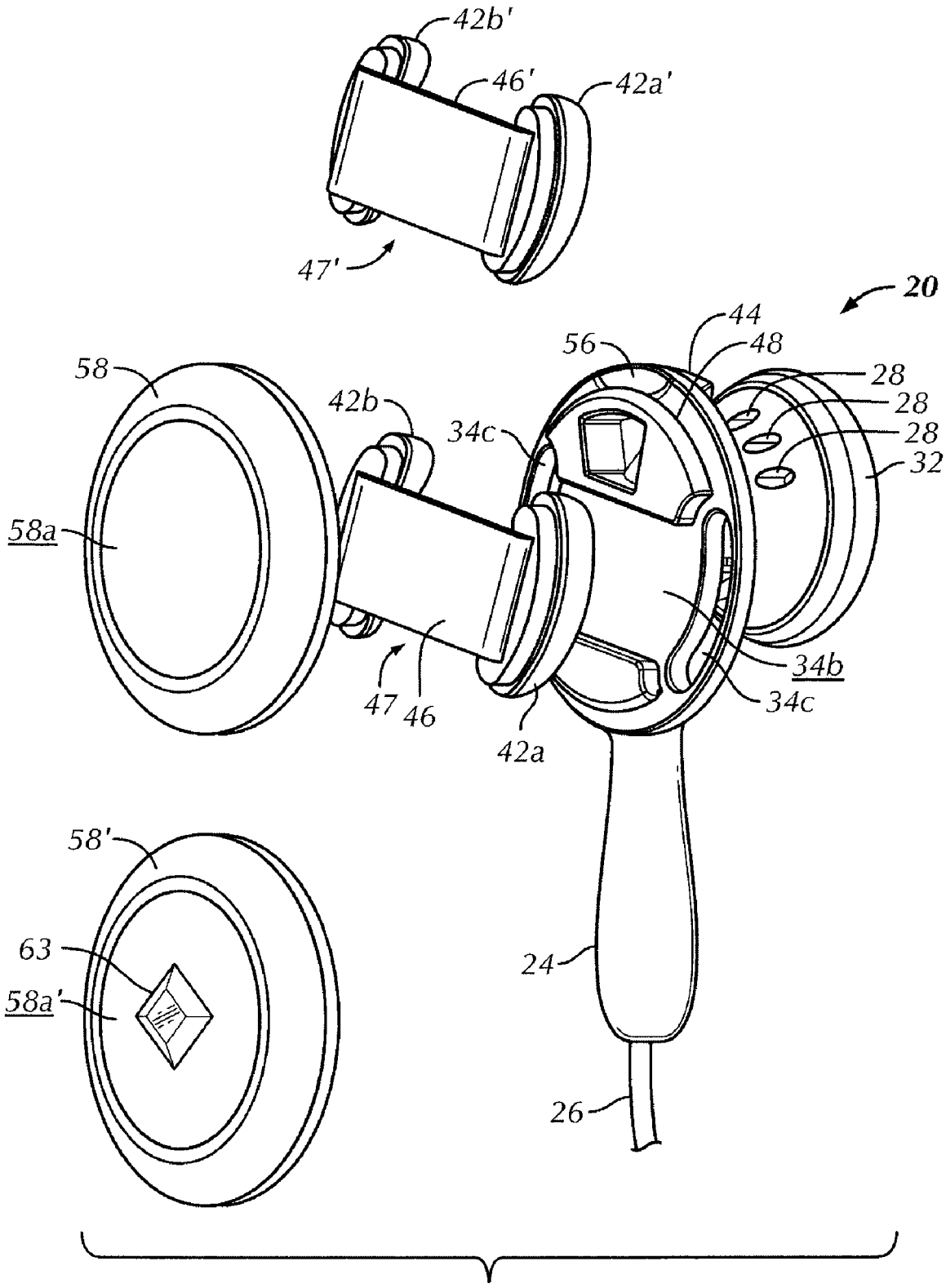
FIG. 6 is a rear side perspective view of the earphone shown in FIG. 5 shown disassembled and with a second, interchangeable lobe assembly and a second interchangeable cap.

Referring to FIGS. 4-6, the base 34 has an interior surface 34*a*. The base 34 is preferably generally circular or cylindrical in shape but may have any shape such as conical, rectangular or semi-spherical. The interior surface 34*a* of the base 34 is preferably planar but the interior surface 34*a* may have any shape such as concave in shape or any desired shape for directing sound toward the ear 2. The interior surface 34*a* of the base 34 is proximate the outer surface of the tragus 12 and the anti-tragus 13 when the earphone 20 is mounted to the ear 2. The base 34 is preferably mounted to the speaker housing 22, opposed from the speaker cover 30, and may be removably or unremovably attached to the speaker housing 22 such that speaker housing 22 is positioned between the speaker cover 30 and the base 34. The wire housing 24 and the base 34 are preferably co-molded and the speaker housing 22 is preferably separately welded or attached to the base 34 and/or the wire housing 24 with epoxy. Though it is preferred that the speaker housing 22 and the base 34 be sold as a single unit, the base 34 may be attached to the speaker housing 22 or wire housing 24 with an epoxy or snap fit such that the base 34 can be used in conjunction with a conventional earphone 5 to reduce the need for manufacturing and purchasing the components of the conventional earphone 5.

The upper end of the base 34 also preferably includes a projection 44 extending generally perpendicularly from the base 34 toward the ear 2 between the first and second tragus arms 38, 40 and is opposed from the wire housing 24. The projection 44 is preferably proximate the outer periphery of the base 34 and preferably proximate the vent holes 28 in the speaker housing 22. The projection 44 is preferably used as a finger support while mounting the earphone 20 to the ear 2. A user may grasp the base 34 of the earphone 20 between a thumb and middle finger and place an index finger on the projection 44 to press the housing 22 down into the ear 2.

First and second tragus lobes 42*a*, 42*b* extend from the base 34 generally toward the speaker housing 22 to form a space on each side of the speaker housing 22 between the first and second tragus lobes 42*a*, 42*b* and the housing 22. The first and second tragus lobes 42*a*, 42*b* are spaced from the speaker housing 22 and are positioned on generally opposite lateral sides of the speaker housing 22 such that the tragus 12 extends between the speaker housing 22 and the second tragus lobe 42*b* and the anti-tragus 13 extends between the speaker housing 22 and the first tragus lobe 42*a* when the earphone 20 is mounted to the ear 2 (see FIG. 3). The first and second tragus lobes 42*a*, 42*b* preferably slightly hold or compress the respective tragus 12 and/or anti-tragus 13 between the first and second tragus lobes 42*a*, 42*b* and the housing 22 to more securely mount the earphone 20 to the ear 2 and prevent the earphone 20 from unintentionally disconnecting from the ear 2.

The first and second tragus lobes 42*a*, 42*b* are opposed from each other but are spaced around the outer periphery of the interior surface 34*a* such that the first tragus lobe 42*a* is closest to the wire housing 24. The first tragus lobe 42*a* is preferably closest to the wire housing 24 because the intertragic notch 11 is typically at an angle with respect to a vertically held or upright head (See FIGS. 2A and 3) and such a slant allows the first and second tragus lobes 42*a*, 42*b* to align with the tragus 12 and anti-tragus 13, respectively. The first and second tragus lobes 42*a*, 42*b* are preferably arcuate or generally crescent shaped to match the shape of the base 34 and to better fit against the tragus 12 and the anti-tragus 13. The crescent shape of the first and second tragus lobes 42*a*, 42*b* allows the first and second tragus lobes 42*a*, 42*b* to wrap around the tragus 12 and anti-tragus 13 that either naturally extend away from the ear 2 at their distal ends or are urged outwardly from the ear 2 when the earphone 20 is mounted to the ear 2. The first and second tragus lobes 42*a*, 42*b* preferably extend a predetermined distance toward the speaker housing 22 to ensure a snug but comfortable fit against the tragus 12 and anti-tragus 13 within an ear 2. That is, the first and second tragus lobes 42*a*, 42*b* preferably extend toward the speaker cover 30 to ensure that the first and second tragus lobes 42*a*, 42*b* contact the tragus 12 or the anti-tragus 13 and earphone 20 is removably held to the ear 2. Thus, the first and second tragus lobes 42*a*, 42*b* help to hold the earphone 20 to the ear 2 and keep the speaker housing 22 in contact with the acoustic meatus 6 and proximate the ear canal 7. However, only one of the first and second tragus lobes 42*a*, 42*b* may be provided to secure the earphone 20 to either the tragus 12 or the anti-tragus 13.

The first and second tragus lobes 42*a*, 42*b* may be moveable or adjustable with respect to the base 34 to customize the fit of the earphone 20 to an individual's ear 2. The tragus lobes 42*a*, 42*b* are preferably arcuate or crescent-shaped to conform to the shape of the base 34, fit comfortably and snugly to the ear 2 and potentially for impacting the acoustic performance, but the tragus lobes 42*a*, 42*b* may have any shape. The first and second tragus lobes 42*a*, 42*b* are preferably constructed of an elastomeric, pliant and/or resilient material such as silicon to alleviate pressure on the tragus 12, anti-tragus 13, respectively, when the earphone 20 is mounted to an ear 2 but the first and second tragus lobes 42*a*, 42*b* may be constructed of any resilient material, such as foam, or may be constructed of a non-resilient material and may be integrally formed with the base 34.

Referring to FIG. 6, the first and second tragus lobes 42*a*, 42*b* are preferably part of a removably mounted first lobe assembly 47. However, the first and second tragus lobes 42*a*, 42*b* may be removably mounted directly to the base 34 or the first and second tragus lobes 42*a*, 42*b* may be integrally formed with the base 34. The first lobe assembly 47 preferably includes a lobe plate 46 that connects and extends between the first and second tragus lobes 42*a*, 42*b*. The tragus lobe plate 46 is preferably constructed of a rigid material, such as metal, to add stiffness to the base 34 when assembled but the tragus lobe plate 46 may be constructed of any suitable material. Alternatively, the lobe plate 46 may be constructed of the same material as the first and second tragus lobes 42*a*, 42*b* to form an integrally formed first lobe assembly 47. The tragus lobe plate 46 is connected to and may be co-molded to the tragus lobes 42*a*, 42*b*, but the tragus lobe plate 46 may be removably mounted or integrally formed with the tragus lobes 42*a*, 42*b* and/or the base 34 or the cap 58. The first and second tragus lobes 42*a*, 42*b* extend through holes 34*c* in the base 34 such that the lobe plate 46 contacts a rear surface 34*b* of the base 34 and the first and second tragus lobes 42*a*, 42*b* project from the front surface 34*a* of the base 34. The holes 34*c* are preferably slightly smaller than the first and second tragus lobes 42*a*, 42*b* such that the first and second tragus lobes 42*a*, 42*b* are compression fit within the holes 34*c* and inserted through the rear surface 34*b*. The first and second tragus lobes 42*a*, 42*b* may be individually adjustable and/or removable with respect to the base 34 by any manner. For example, the first and second tragus lobes 42*a*, 42*b* may be press or snap fit onto protrusions (not shown) on an outer periphery of the front surface 34*a*, slip or compression fit into features (not shown) that include an o-ring type of groove or slide inwardly into grooves from the outer periphery of the base 34 such that a user can customize the fit of the earphone 20 to the specific size and shape of their ear 2 and the first and second tragus lobes 42*a*, 42*b* sufficiently contact or hold the earphone 20 to the tragus 12 and/or the anti-tragus 13.

Figure 10:
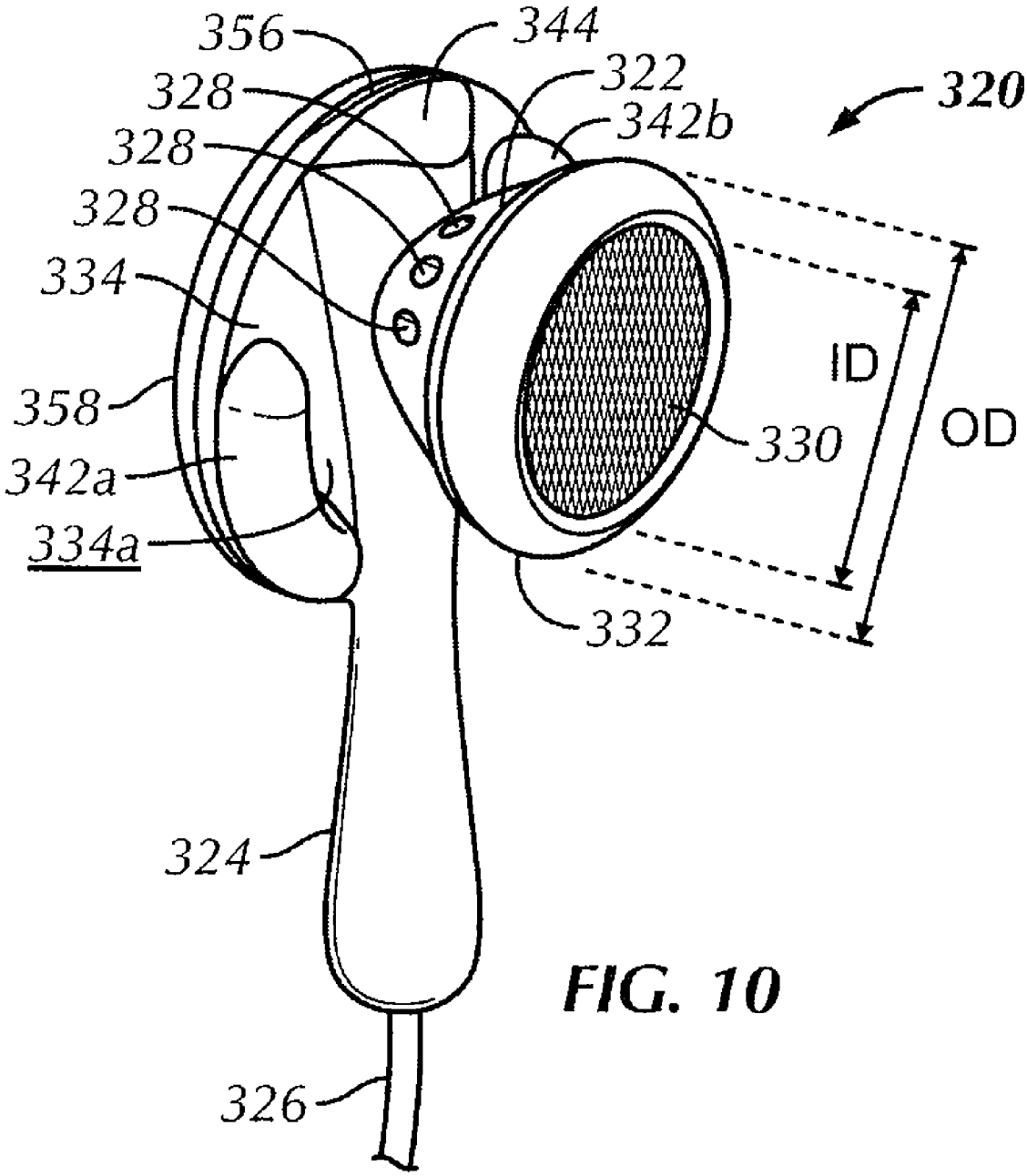
FIG. 10 is a front side perspective view of an earphone in accordance with a third preferred embodiment of the present invention.
Figure 11:
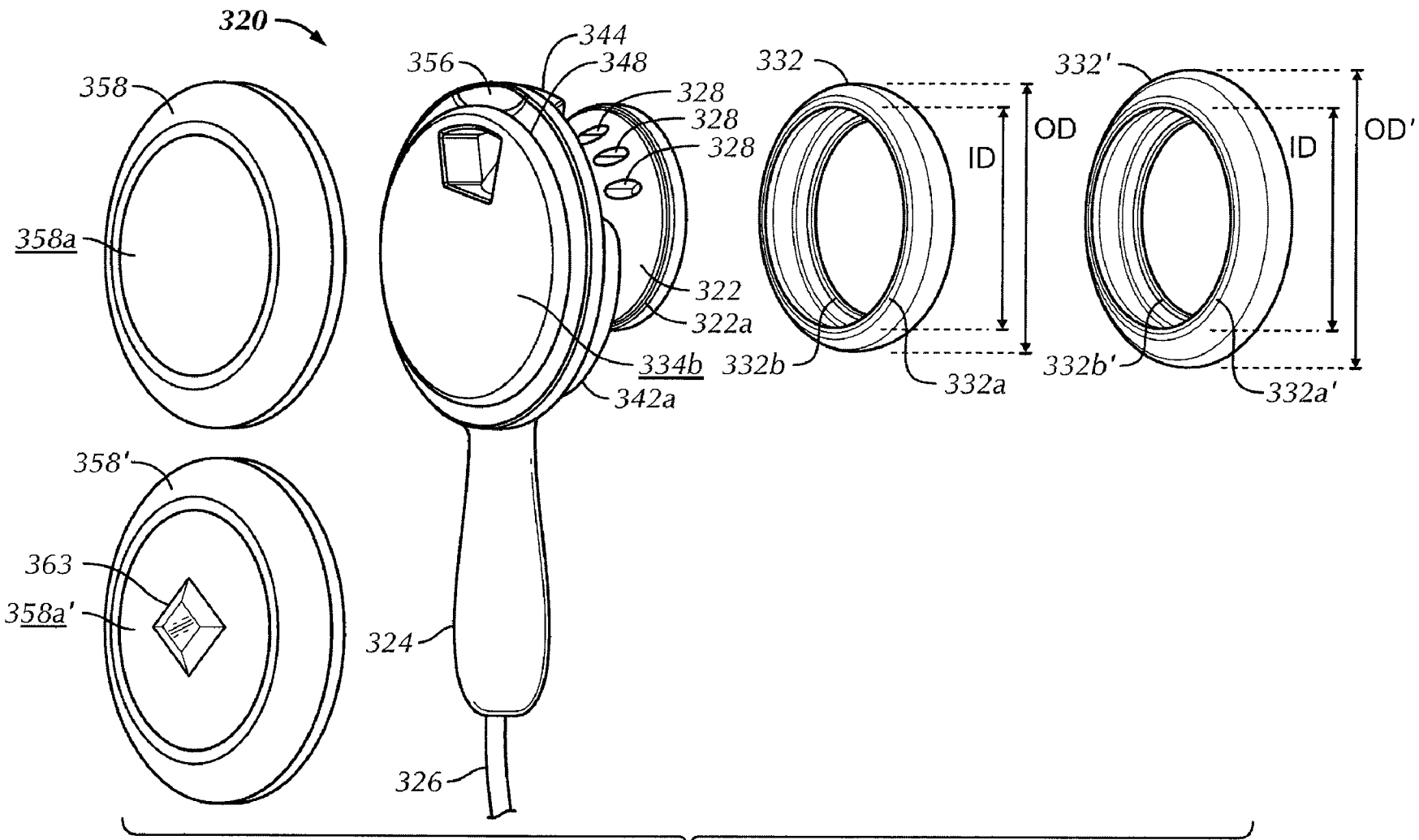
FIG. 11 a rear side perspective view of the earphone shown in FIG. 5 shown disassembled and with a second, interchangeable ring and a second interchangeable cap.
Figure 12:
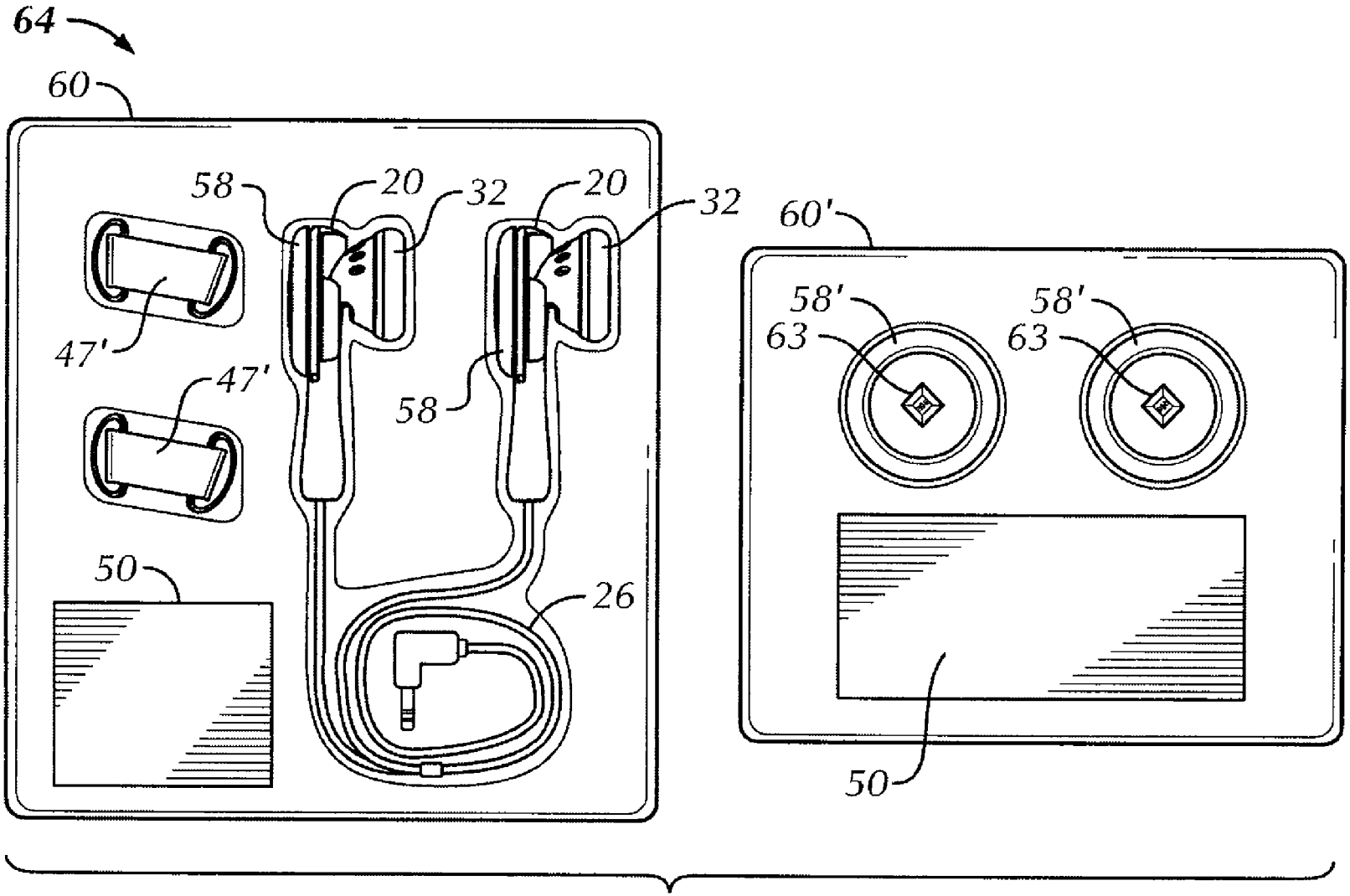
FIG. 12 is a top plan view of an earphone kit having a first package that includes a pair of the earphones shown in FIG. 3 and a second package that includes a pair interchangeable replacement caps.

The first lobe assembly 47 is preferably partially covered and secured to the base 34 by a removably and selectively mounted cap 58. The rear surface 34*b* of the base 34 preferably includes a circular recess 48 around the outer periphery of the base 34. The base 34 also preferably includes an access groove 56 proximate the circular recess 48 extending inwardly and positioned toward the top of the earphone 20. The cap 58 preferably snap fits into the circular recess 48 such that the first lobe assembly 47 is held in place by the cap 58 and removable the cap 58 allows the first lobe assembly 47 to be removed. The cap 58 preferably retains the first lobe assembly 47 such that the first and second tragus lobes 42*a*, 42*b* do not unintentionally detach from the earphone 20. The access groove 56 allows for insertion of a finger, coin or other object to pry or otherwise remove the cap 58 from the base 34. The cap 58 is preferably similarly shaped to the base 34 and has a generally planar outer surface 58*a*. However, the cap 58 may have any shape, the shape potentially extending past outer periphery of the base 34 and the cap 58 may have any shaped outer surface 58*a* such as conical or semi-spherical. The cap 58 is preferably replaceable such that the earphone 20 comes with or can be used with a variety of differently shaped or ornamental caps 58, 58', 58" (FIGS. 6, 10 and 11). The cap 58 is preferably constructed of a polymeric material and may have a printed logo or graphic 62 as shown in FIG. 3 or an embedded real or faux jewel 63 as shown in FIG. 6. However, the cap 58 may have any ornamental appearance and shape, and may contain any type of jewelry, a decorative protrusion extending outwardly, a flashing light or lights, furry or textured materials, an action figure or a cartoon character or any other decorative object or configuration. It is expected that differently decorated caps 58, 58', 58" will be included and/or sold separately as discussed further below so that end users can choose different decorative patterns for the earphones 20 depending on the attire or event of the day.

The earphone 20 preferably includes at least one interchangeable second lobe assembly 47' that has third and fourth tragus lobes 42*a*', 42*b*'. The third and fourth tragus lobes 42*a*', 42*b*' are similar to the first and second tragus lobes 42*a*, 42*b* except that the third and fourth tragus lobes 42*a*', 42*b*' are different in size or otherwise provide for a different space between the third and fourth tragus lobes 42*a*', 42*b*' and the speaker housing 22 than the first and second tragus lobes 42*a*, 42*b*. The first and second lobe assemblies 47, 47' are preferably removably mounted to the base 34 such that differently shaped and or sized lobes 42*a*, 42*b*, 42*a*', 42*b*' can be mounted to the base 34. Differently sized or shaped lobes 42*a*, 42*b*, 42*a*', 42*b*' may be desired to provide for a different fit to the ear 2 such as holding the tragus 12 or anti-tragus 13 more tightly between the speaker housing 22 and the tragus lobes 42*a*, 42*b*. That is, the earphone 20 can be provided with a second lobe assembly 47' or additional lobe assemblies (not shown) that the user can switch between to find the best fit for retaining the earphone 20 in the ear 2. The tragus lobes 42*a*, 42*b*, 42*a*', 42*b*' provide a more secure fit to the ear 2 as compared to conventional earphones 5. Though it is preferred that the first and second lobe assemblies 47, 47' be interchangeable, the lobe plate 46 may be fixedly attached or integrally formed with the base 34 and the differently shaped and or sized lobes 42*a*, 42*b*, 42*a*', 42*b*' may be removeably mounted to the base 34 or respective lobe plate 46, 46'. It is expected that two or more replaceable lobe assemblies 47' will be included with the earphones 0 and/or sold separately as discussed further below. Though it is preferred that the first and second tragus lobes 42*a*, 42*b* are attached to form the first lobe assembly 47, the first and second tragus lobes 42*a*, 42*b* may be separately attached.

Figure 7:
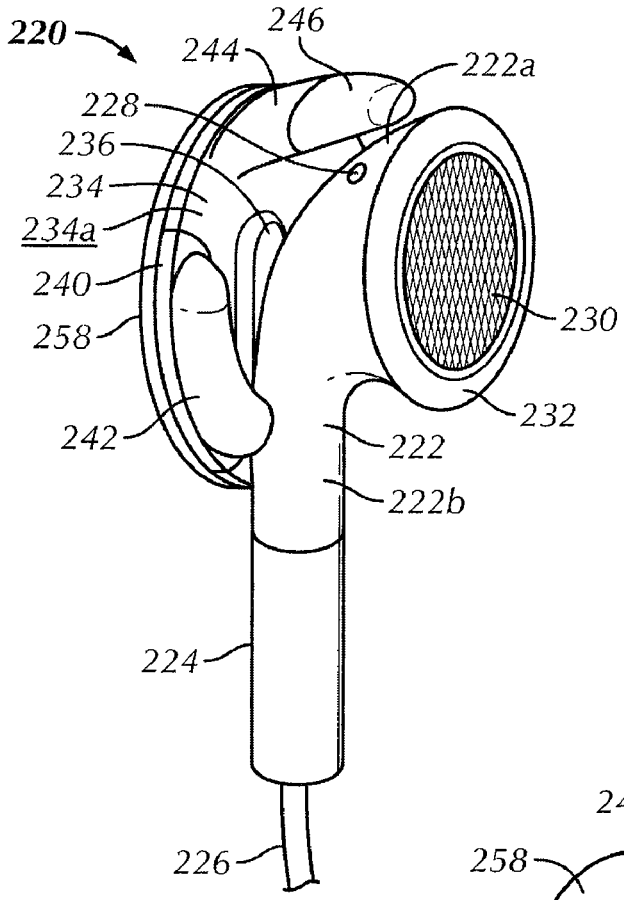
FIG. 7 is a front side perspective view of an earphone in accordance with a second preferred embodiment of the present invention.
Figure 8:
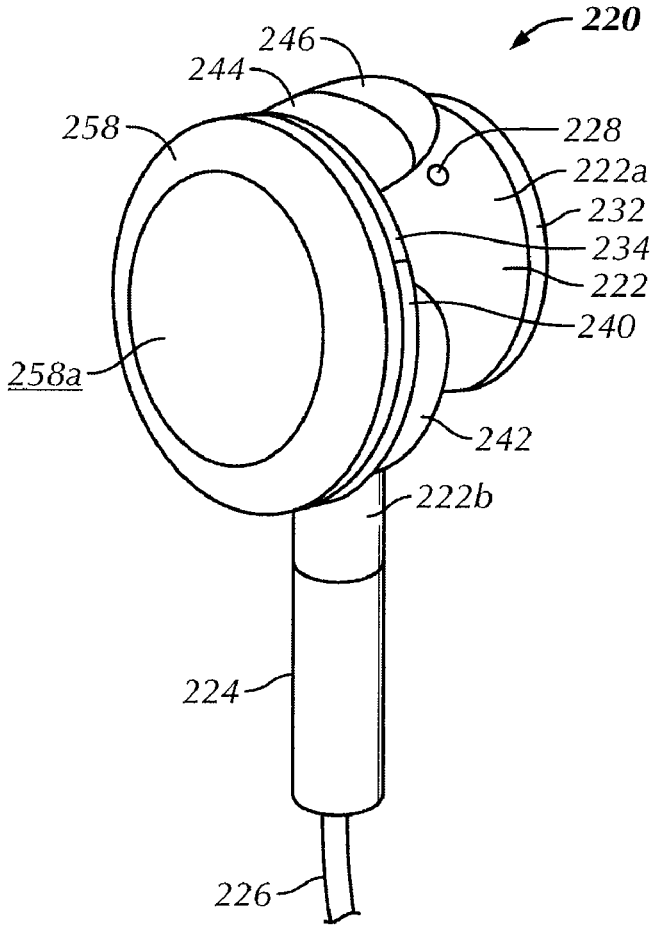
FIG. 8 is a rear side perspective view of the earphone shown in FIG. 7.
Figure 9:
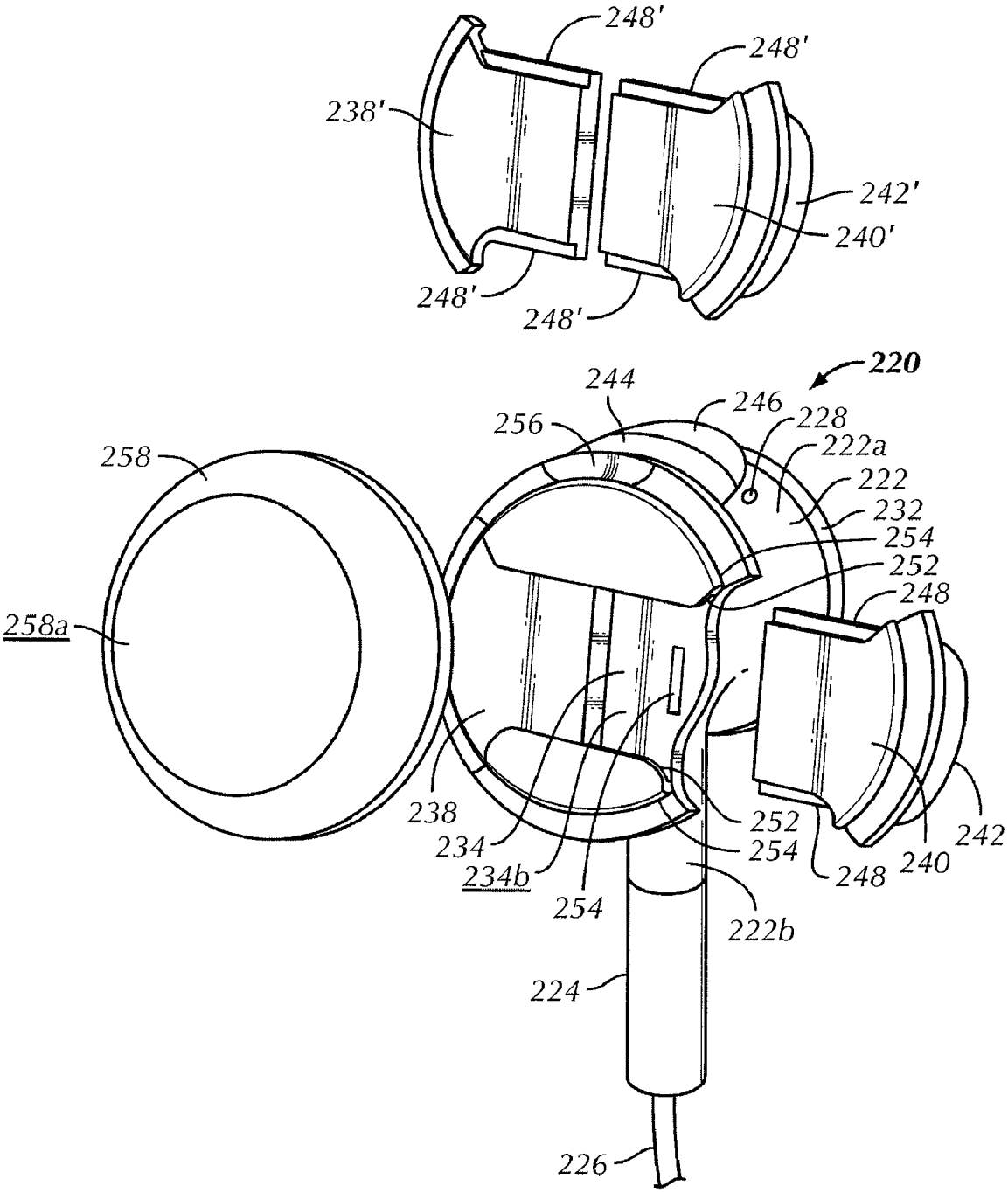
FIG. 9 is a rear side perspective view of the earphone shown in FIG. 7 shown disassembled and with third and fourth interchangeable tragus arms.

Referring to FIG. 7-9, there is shown a second preferred embodiment of the earphone, generally designated 220. The earphone 220 is generally similar to the earphone 20 except that the first and second tragus lobes 242 of the earphone 220 are mounted to separately removably mounted first and second tragus arms 238, 240.

The earphone 220 includes a speaker housing 222 for enclosing a speaker and electrical components (not shown) and a wire housing 224 for housing electrical wiring (not shown) extending from the speaker housing 222. The wiring is encased in a protective sheath 226. The speaker housing 222 and the enclosed electronics, the wire housing 224, the sheath 226 and the wiring within the sheath 226 are similar to the respective components of the conventional earphone 5. The speaker housing 222 and the wire housing 224 are preferably constructed of a molded generally rigid polymeric material and the sheath 226 is preferably constructed of a flexible polymeric material as is known in the art. The details of the components within the speaker and wire housings 222, 224 are known by one having ordinary skill and the art and further detail of the internal components of the speaker and wire housings 222, 224 is omitted for brevity purposes only and is not limiting.

The speaker housing 222 preferably includes a frusto-conically-shaped head 222*a* and thinner, downwardly extending stem 222*b* such that the speaker housing 222 is generally shaped similar to a detachable sink or shower head. The shape of the speaker housing 222 is shaped such that when the earphone 220 is mounted to an ear 2 (see FIG. 3), the head 222*a* at least partially contacts the acoustic meatus 6 between the tragus 12 and anti-tragus 13 of the ear 2 and the stem 222*b* extends through and rests on the intertragic notch 11 similar to the conventional earphone 5 (details of the ear shown in FIGS. 2A and 3). The wire housing 224 extends downwardly from the stem 222*b* and the sheath 226 extends downwardly through the wire housing 224. The wire housing 224 and the stem 222*b* are preferably formed of two separate components to facilitate assembly, but the wire housing 224 and the stem 222*b* may be integrally formed. When the earphone 220 is mounted to the ear 2, stem 222*b* remains in contact with the intertragic notch 11 and the head 222*a* remains positioned in at least partial contact with the acoustic meatus 6 between the tragus 12 and anti-tragus 13. The head 222*a* may include one or more vent holes 228 to allow sound and air to enter and exit the rear of speaker housing 222 as known by one of ordinary skill in the art. The wire housing 224 and/or the stem 222*b* may be contained within the base 234 and one or both may extend no further than the outer periphery of the base 224.

The head 222*a* of the speaker housing 222 includes a speaker cover 230 for allowing sound to project through the speaker housing 222 and toward and eventually into the ear canal 7. The speaker cover 230 is constructed of a finely grated metallic screen or a porous polymeric screen as is generally known in the art. The speaker housing 222 also preferably includes a resilient ring 232 extending around the outer periphery of the head 222*a* at the largest diameter such that the resilient ring 232 at least partially contacts the ear 2. The resilient ring 232 preferably reduces the pressure on the ear 2 as compared to the rigid polymeric material of the speaker housing 222. The resilient ring 232 is preferably removably mounted to the head 222*a* such that the resilient ring 232 may be replaced by a new or differently sized resilient ring 232 and is held in place by a compress and grooved fit (not visible). The resilient ring 232 is preferably constructed of a rubber material but the resilient ring may be constructed of any elastomeric, resilient or pliant material, such as silicon or foam. Though it is preferred that the resilient ring 232 be ring-shaped, the resilient ring 232 may have any shape such as entirely covering a larger portion of the head 222*a* with the exception of covering the speaker cover 230. Similarly, the stem 222*b* may have a resilient component (not shown) or covering such that the intertragic notch 11 is in contact with the resilient component.

The earphone 220 includes a base 234. The base 234 is preferably generally circular in shape but may have any shape such as conical, rectangular or semi-spherical. The interior surface 234*a* is preferably planar but the interior surface 234*a* may have any shape such as concave in shape or a specific shape for directing sound toward the ear 2. The interior surface 234*a* is proximate the outer surface of the tragus 12 and the anti-tragus when the earphone 220 is mounted to the ear 2. The base 234 is mounted to the speaker housing 222, preferably the stem 222*b*, and may be removably or unremovably attached to the speaker housing 222. The base 234 may also be integrally molded with the speaker housing 222. The base 234 includes a vertically extending groove 236 for complementarily receiving the stem 222*b*. Though it is preferred that the speaker housing 222 and the base 234 be sold as a single unit, the base 234 may be attached to the stem 222*b* with an epoxy such that the base 234 can be used in conjunction with a conventional earphone 5 to reduce the need for manufacturing and purchasing the components of the conventional earphone 5.

The base 234 supports a first tragus arm 238 and a second tragus arm 240. The first and second tragus arms 238, 240 extend in generally opposing radial directions. The first and second tragus arms 238, 240 are spaced from the head 222*a* of the speaker housing 222 such that the tragus 12 extends between the head 222*a* and the first tragus arm 238 and the anti-tragus 13 extends between the head 222*a* and the second tragus arm 240 when the earphone 220 is mounted to the ear 2 (see FIG. 3). As shown in FIG. 6, the groove 236 is preferably positioned at an angle with respect to the radial extension of the first and second tragus arms 238, 240. The groove 236 is slanted with respect to the first and second tragus arms 238, 240 because the intertragic notch 11 is typically at an angle with respect to a vertically held or upright head (See FIGS. 2A and 3) and such a slant of the groove 236 allows the first and second tragus arms 238, 240 to align with the tragus 12 and anti-tragus 13, respectively. The first and second tragus arms 238, 240 each include a lobe 242 extending generally perpendicularly from the base 234 toward the ear 2. The lobes 242 preferably extend a predetermined distance to ensure a snug fit within an ear 2. That is, the lobes 242 preferably extend to a depth that contacts the tragus 12 or the anti-tragus 13. More particularly, the tragus 12 and anti-tragus 13 are pinched between the housing 222 and the lobes 242 to more securely hold the earphone 220 in the ear. Thus, the first and second tragus arms 238, 240 and their corresponding lobes 242 help to hold the earphone 220 to the ear 2 and keep the head 222*a* of the speaker housing 222 in contact with the acoustic meatus 6 and proximate the ear canal 7. The first and second tragus arms 238, 240 may be sized to position or angle the earphone 220 to a predetermined position with respect to the ear 2.

The upper end of the base 234 also preferably includes a projection 244 extending generally perpendicularly from the base 234 toward the ear 2 between the first and second tragus arms 238, 240 and is opposed from the groove 236. The projection 244 is preferably proximate the outer periphery of the base 234 and preferably proximate the vent holes 228 in the speaker housing 222. The projection 244 may include a removable concha extension 246. The projection 244 and concha extension 246 may help to direct sound from the vent holes 228, and any other sound exiting from the speaker away from the ear canal 7, back toward the vent holes 228 and/or toward the ear 2. The projection 244 and concha extension 246 may also help to partially shield outside noises from entering the ear canal 7. The concha extension 246 is preferably constructed of a resilient material such as rubber or silicon and may be replaceable to vary the length of the projection 244. The concha extension 246 may alternatively be integrally formed with the projection 244. The concha extension 246 preferably contacts the concha 10 of the ear 2 to change the acoustic properties of the ear and to help hold the earphone 220 in the ear.

The lobes 242, the projection 244 and the concha extension 246 are preferably arcuate or crescent-shaped to conform to the shape of the base 234 and potentially for acoustic performance, but the lobes 242 and projection 244 and concha extensions may have any shape. The lobes 242 and the concha extension 246 are preferably constructed of an elastomeric material to alleviate pressure of the tragus 12, anti-tragus 13 and the concha 10, respectively, when the earphone 220 is mounted to an ear 2 but the lobes 242 and concha extension 246 may be constructed of any elastomeric or resilient material such as silicon or foam or may be constructed of a non-resilient material and integrally formed with the respective first and second tragus arms 238, 240 or projection 244.

Referring to FIG. 9, the first and second tragus arms 238, 240 are preferably removably mounted to the base 234 such that at least third and fourth tragus arms 238', 240' having differently shaped and or sized lobes 242' can be mounted to the base 234. Differently sized or shaped lobes 242' may be desired to provide for a different fit to the ear 2 such as holding the tragus 12 or anti-tragus 13 more tightly between the head 222*a* and the lobes 242. That is, the earphone 220 can be provided with different size sets of lobes 242, 242' attached to the earphone 10 in any manner such that the user can switch between differently sized lobes 242, 242' to find the best fit for retaining the earphone 220 in the ear. The lobes 242, 242' provide a more secure fit over conventional earphones. The third and fourth tragus arms 238', 240' are similar in structure to the first and second tragus arms 238, 240 as described further below.

The first and second tragus arms 238, 240 have laterally extending and opposed rails 248. A rear surface 234*b* of the base 234 preferably includes slots 252 for receiving and retaining the rails 248 of the first and second tragus arms 238, 240. The rear surface 234*b* also includes a pair of indents 254 (only one shown) for receiving and retaining corresponding outwardly extending projections (not visible) of the first and second tragus anrs 238, 240. The mating projections and indents 254 preferably create a slight snap fit such that a predetermined amount of force is required to insert and slide the rails 248 with respect to the slots 252 and either insert or remove the first and second tragus arms 238, 240 from the base 234.

When assembled, the rear surface 234*b* of the base 234 and first and second tragus arms 238, 240 preferably form a circular recess 248 around the outer periphery of the base 234. The base 234 also preferably includes an access groove 256 proximate the circular recess 246. The base 234 preferably includes a cap 258 that has an outwardly extending rim (not visible) and a radially inwardly extending lip (not visible). The rim of the cap 258 preferably snap fits into the circular recess 248 such that the first and second tragus arms 238, 240 are further held in place by the cap 258 and the cap 258 is releasably mounted to the base 234. The cap 258 preferably retains the first and second tragus arms 238, 240 such that the first and second tragus arms 238, 240 do not unintentionally detach from the earphone 220. The access groove 256 allows for insertion of a finger, coin or other object to access a portion of the rim and pry the rim of the cap 258 from the base 234 to remove the cap 258 from the base 234. The cap 258 is preferably similarly shaped to the base 234 and has a generally planar outer surface 258*a*. However, the cap 258 may have any shape, may extend past the base 234 and the cap 258 may have any shaped outer surface 258*a* such as conical or semi-spherical. The cap 258 is preferably replaceable such that the earphone 220 comes with or can be used with a variety of differently shaped or ornamental caps 258. The cap 258 is preferably constructed of a polymeric material and may have a printed logo or graphic 62 as shown in FIG. 3 on the earphone 20 or other lettering or ornamental designs. However, the cap 258 may have any ornamental appearance and shape, and may contain any type of jewelry, a decorative protrusion extending outwardly, a flashing light or lights, furry or textured materials, an action figure or a cartoon character or any other decorative object or configuration. It is expected that, similar to the first embodiment, differently decorated caps 58, 58', 58" will be included and/or sold separately as discussed further below so that end users can choose different decorative patterns for the earphones 220 depending on the attire or event of the day.

Referring to FIG. 10 and 11, there is shown a third preferred embodiment of the earphone, generally designated 320. The earphone 320 is similar to the earphones 20 of the first preferred embodiment except that the first and second tragus lobes 342 of the earphone 220 are preferably fixedly mounted to the base 334 and the ring 332 is removably mounted to the speaker housing 322.

The ring 332 is removably and selectively mounted to the speaker housing 322. The ring 332 extends around the outer periphery of the speaker housing 322, preferably at the largest diameter of the speaker housing 322 such that the ring 332 at least partially contacts the ear 2. The ring 332 is preferably constructed of an elastomeric, resilient or pliant material such as rubber, silicon or foam but the ring 332 may be constructed of any suitable material that reduces the pressure on the ear 2 as compared to the rigid polymeric material of the speaker housing 322. The ring 332 has an outer diameter OD and an inner diameter ID. The outer diameter OD of the ring 332 preferably extends outwardly further than any portion of the speaker housing 322 such that the ring 332 contacts the ear 2 rather than the speaker housing 322 contacting the ear 2. The initial ring 332 is removably and selectively mounted to the speaker housing 322 such that the ring 332 may be replaced by a new ring 332 or differently sized replacement ring 332'. The replacement ring 332' has an outer diameter OD' and an inner diameter ID. The outer diameter OD' of the replacement ring 332' is preferably larger than the outer diameter OD of the initial ring 332 in order to provide a different fit within the ear 2 and more securely hold the tragus 12 and the anti-tragus 13 between the respective tragus lobe 342*b*, 342*a* and the speaker housing 322. The inner diameter ID of the replacement ring 332' is preferably generally equal to the inner diameter ID of the initial ring 332 such that either ring 332, 332' may be held in place by a compression and grooved or snap fit onto a groove 322' on the speaker housing 322. An inwardly extending ridge 332*a*, 332*a'* is preferably received into the groove 322*a*. The rings 332, 332' also preferably include an inwardly extending flange 332*b*, 332*b'* that abuts the speaker housing 322 proximate the speaker cover 330 to prevent the rings 332, 332' from being overly installed or slid past the groove 322*a*. Additional replacement rings 332" (FIG. 13 for example and even further sizes/shapes not shown) may also be used and/or provided with the earphone 320 to allow the user to select the proper or most comfortable size for their particularly shaped ear 2. Although it is preferred that the rings 332, 332' be ring-shaped and have a similar shape to each other except for their outer diameter or size, the rings 332, 332' may have any shape, including being differently shaped from each other, and may cover a larger portion of the speaker housing 322. The rings 332, 332' may form a partial circle rather than a complete ring such that the rings 332, 332' only extend around a portion of the speaker housing 322 where the speaker housing 322 is most likely to contact the ear 2. Additionally, the wire housing 324 may have a resilient component (not shown) or covering such that the intertragic notch 11 is in contact with the resilient component rather than in direct contact with the generally rigid material of the wire housing 324.

The first and second tragus lobes 342*a*, 342*b* are preferably fixedly mounted or formed directly to the base 34. However, The first and second tragus lobes 342*a*, 342*b* may be moveable or adjustable with respect to the base 334 to customize the fit of the earphone 320 to an individual's ear 2 and/or to interchange the first and second tragus lobes 342*a*, 342*b* with replacement tragus lobes (not shown). The first and second tragus lobes 342*a*, 342*b* may be moveably or removeably mounted to the base 334 as described for the first and second embodiments of the earphone 20, 220. The adjustment or fit of the earphone 320 is preferably controlled by the size of the ring 332 rather than the size and/or position of the tragus lobes 342*a*, 342*b*, although the tragus lobes 342*a*, 342*b* may be adjustable as well to provide increased customization to the size of a user's ear.

The earphone 320 preferably includes removeably and selectively mounted decorative caps 358, 358' similar to the caps 58, 258 of the first and second embodiments.

Referring to FIG. 10, the earphones 20, 220, 320 are preferably sold as a decorative earphone kit 64. The earphone kit 64 preferably includes a first package 60 that contains a pair of earphones 20 and a pair of second lobe assemblies 27'. However, the pair of second lobe assemblies 27' may be separately provided. The first package 60 is preferably a generally rigid transparent polymeric clam shell package as known in the art but the first package 60 may be constructed of any suitable material and have any configuration. The first package 60 may also include any number of interchangeable second caps 58' and lobe assemblies 47, 47' for use with the headphones 20. However, the decorative earphone kit 64 preferably includes a separate second package 60'. The second package 60' preferably includes a pair of interchangeable second caps 58' but the second package 60' may include any combination of caps 58, 58' and/or lobe assemblies 47, 47'. The third second or replacement caps 58' preferably include a real or faux jewel 63 to be interchange with the initial or first caps 58 but the second caps 58' may have any differently decorative surface such that the user has an additional decorative cap option. The user preferably has a plurality of second packages 60' to chose from in order to accessorize and customize their earphones 20 provided in the first package 60.

Figure 13:
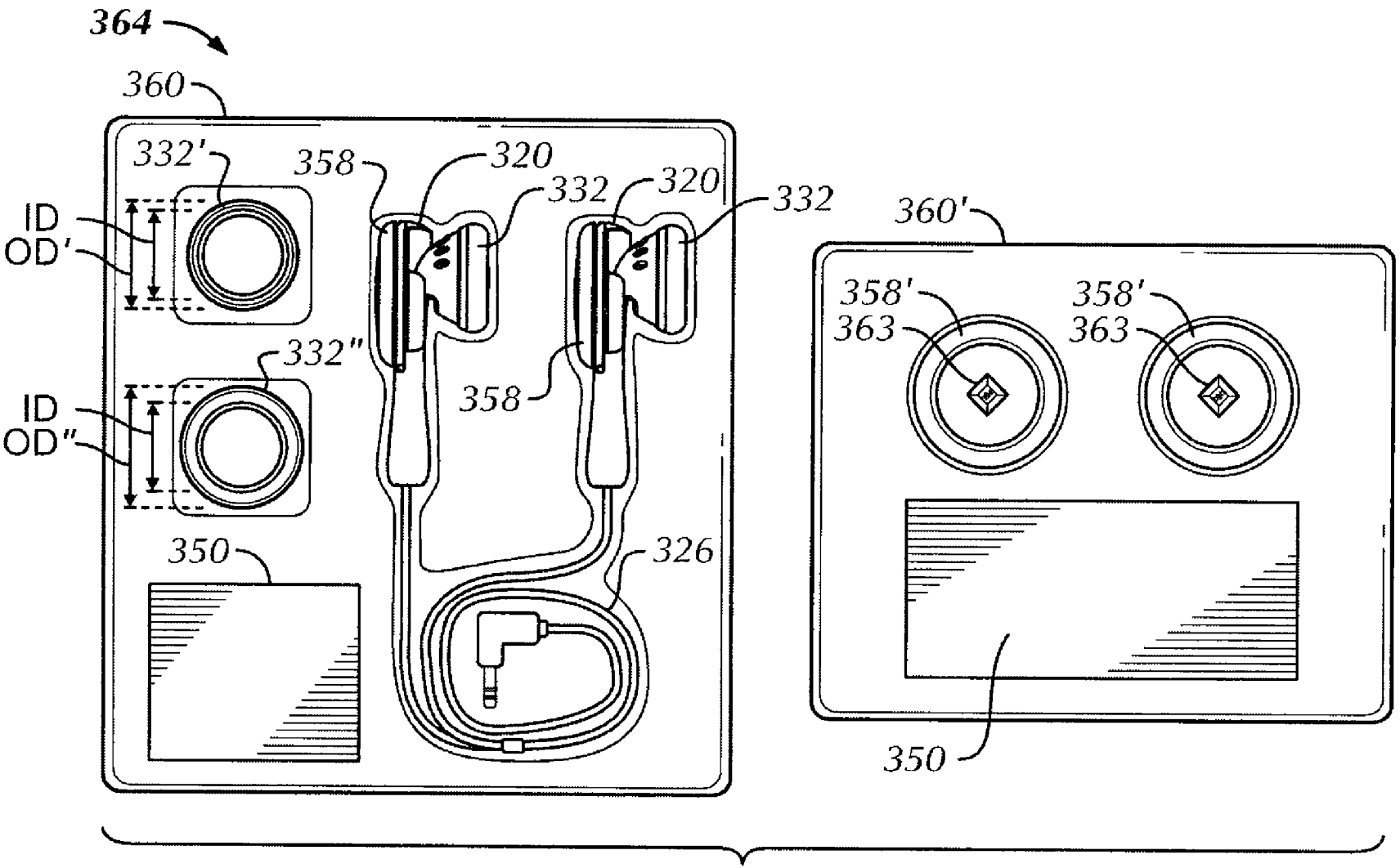
FIG. 13 a top plan view of an earphone kit having a first package that includes a pair of the earphones shown in FIG. 10 and two pairs of interchangeable replacement rings and a second package that includes a pair interchangeable replacement caps.

Referring to FIG. 13, an earphone kit 364, similar to the earphone kit 64, may be directed more specifically to the earphone 320 of the third embodiment. As a result, the first package 360 may include additionally interchangeable replacement rings 332', 332" for use with the earphones 320. Preferably, the first package 360 includes two pairs of interchangeable replacement rings 332', 332" in addition to the initial rings 332 such that the earphones 320 has three possible assembled sizes. Though it is preferred that the first package 360 include three total pairs of rings 332, 332', 332", the first package 360 may include any number of rings 332 or components similar to the first package 60 described above. The replacement rings 332', 332" or additional replacement rings 332', 332" may be separately provided.

The earphone 20, 320 may be fully assembled within the first packages 60, 360 as shown or the first lobe assembly 47, the initial rings 332 and cap 58, 358 may be initially detached from the base 34, 334 as shown in FIGS. 6 and 11. The first and second packages 60, 60', 360, 360' preferably include a decorative and/or informative label 50, 350 that includes brand markings and product information (not shown).

The earphone kit 64 is preferably sold by packaging the earphones 20, 220, 320 and corresponding accessories, such as replacement caps 58, 58', replacement rings 332', 332" and/or assemblies 47, 47', and then shipping the first package 60 to a retail establishment (not shown) for sale to an end user. The second package 60' is shipped either separately or together with the first package 60 to the retail establishment. The retail establishment then displays the first and second packages 60, 60' at the retail establishment to allow a user to purchase the first and second packages 60, 60'. A user may buy the first package 60, the user may mix and match the first and second packages 60, 60' during an initial purchase to purchase the decorative earphone kit 64 or the user may separately buy the second package 60' to interchange the caps 58, 58', replacement rings 332", 332Δ and/or lobe assemblies 47, 47' with a pre-owned earphone 20, 220, 320. The earphone kit 64, the first package 60, or a separately sold second package 60', may also be directly shipped to the user through a telephone or internet purchase.

The earphones 220, 330 of the second and third embodiments may be packaged and sold in a similar manner as described and shown for the earphones 20 and may be configured such that components for one earphone 20, 220, 320, such as the caps 58, 58', 258, 358 for example, are used interchangeably between the various earphones 20, 220, 320.

It will be appreciated by those skilled in the art that changes could be made to the embodiments described above without departing from the broad inventive concept thereof. The tragus arms 238, 240 for example, could be directly connected to the head 222*a* as part of a molding process. Similarly, the tragus arms 238, 240 could be movable with respect to the head 222*a* for adjustment without providing differently sized and interchangeable parts. Further, the removable caps 58, 58', 58" may also be adapted for use with earphones 5 not including a lobe assemblies 47, 47' or tragus arms 238, 240. It is understood, therefore, that this invention is not limited to the particular embodiments disclosed, but it is intended to cover modifications within the spirit and scope of the present invention as defined by the appended claims.

I claim:

1. An earphone for projecting sound into an ear having an acoustic meatus, a tragus, an intertragic notch, an anti-tragus and a canal, the earphone comprising:

a base positioned proximate an outer surface of the tragus and anti-tragus when the earphone is mounted to the ear;

a speaker housing at least partially contacting the acoustic meatus of the ear and including a speaker cover positioned proximate the canal when the earphone is mounted to the ear; and first and second tragus lobes extending from the base generally toward the speaker housing, the first and second tragus lobes being spaced from and positioned proximate generally opposite lateral sides of the speaker housing, the anti-tragus being held between the first tragus lobe and the speaker housing when the earphone is mounted to the ear and the tragus being held between the second tragus lobe and the speaker housing when the earphone is mounted to the ear.

2. The earphone of claim 1, wherein the speaker housing includes a removable ring proximate the speaker cover and is constructed of a pliant material for at least partially contacting the ear.

3. The earphone of claim 1, wherein the first and second tragus lobes are constructed of a pliant material.

4. The earphone of claim 1, wherein the first and second tragus lobes are generally crescent shaped.

5. The earphone of claim 1, wherein a wire housing extends from the base and the wire housing is sized to extend through and partially rest on the intertragic notch when the earphone is mounted to the ear.

6. The earphone of claim 1, wherein the first and second tragus lobes are interchangeable with third and fourth tragus lobes.

7. The earphone of claim 6, wherein the first and second tragus lobes are independently interchangeable with third and fourth tragus lobes respectively.

8. The earphone of claim 6, wherein an inwardly facing surface of the third and fourth tragus lobes are spaced further from the speaker housing when mounted to the base than an inwardly facing surface of the first and second tragus lobes are spaced from the speaker housing when mounted to the base.

9. The earphone of claim 1, wherein the first and second tragus lobes are movably mounted to the base to adjust the space between the first and second tragus lobes and the speaker housing.

10. The earphone of claim 9, wherein the first and second tragus lobes are attached to a tragus lobe plate that is removably mounted to the base.

11. The earphone of claim 10, wherein the lobe plate is at least partially covered by a cap that is removably mounted to the base.

12. The earphone of claim 11, wherein the first and second tragus arms are at least partially covered by a cap that is removably mounted to the base.

13. The earphone of claim 1, wherein the first and second tragus lobes are mounted to respective first and second tragus arms that are independently removably mounted to the base.

14. The earphone of claim 13, wherein the first and second tragus arms are at least partially held in place with respect to the base by the cap.

15. The earphone of claim , wherein the projection includes a concha extension constructed of a pliant material.

16. The earphone of claim 1, wherein the base includes an outwardly extending projection between the first and second tragus lobes that is spaced from the speaker housing and positioned proximate the concha when the earphone is mounted to the ear.

* * * * *